US011306447B2

(12) United States Patent
Berns

(10) Patent No.: US 11,306,447 B2
(45) Date of Patent: Apr. 19, 2022

(54) METHODS AND SYSTEMS FOR DETERMINING AN ANGLE OF ATTACK AND A CROSS SLOPE OF A PAVING MACHINE

(71) Applicant: Caterpillar Paving Products Inc., Brooklyn Park, MN (US)

(72) Inventor: Reece A. Berns, Otsego, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 54 days.

(21) Appl. No.: 16/832,951

(22) Filed: Mar. 27, 2020

(65) Prior Publication Data

US 2021/0301478 A1 Sep. 30, 2021

(51) Int. Cl.

| | |
|---|---|
| ***E01C 19/48*** | (2006.01) |
| ***E01C 19/42*** | (2006.01) |
| *E01C 19/00* | (2006.01) |

(52) U.S. Cl.

CPC ..... *E01C 19/48* (2013.01); *E01C 19/42* (2013.01); *E01C 19/004* (2013.01); *E01C 2301/10* (2013.01)

(58) Field of Classification Search

CPC ..... E01C 19/004; E01C 19/42; E01C 19/48; E01C 2301/10

USPC ..... 404/84.05–84.5, 72, 75, 117

See application file for complete search history.

(56) References Cited

U.S. PATENT DOCUMENTS

| | | | | |
|---|---|---|---|---|
| 3,554,291 | A * | 1/1971 | Rogers | E02F 3/847 172/4.5 |
| 5,039,246 | A | 8/1991 | Woodruff et al. | |
| 5,401,115 | A * | 3/1995 | Musil | E01C 19/008 404/72 |
| 6,238,135 | B1 | 5/2001 | Rower | |
| 6,273,636 | B1 * | 8/2001 | Johanpeter | E01C 19/4893 404/104 |
| 6,530,721 | B2 | 3/2003 | Yost | |
| 6,758,631 | B2 | 7/2004 | Frankeny, II | |
| 7,077,601 | B2 * | 7/2006 | Lloyd | E01C 23/065 180/209 |
| 7,559,718 | B2 * | 7/2009 | Zachman | E01C 19/004 404/83 |
| 8,371,769 | B2 | 2/2013 | Worsley et al. | |
| 9,534,348 | B2 | 1/2017 | Rio et al. | |
| 2014/0186115 | A1 * | 7/2014 | Graham | E01C 23/07 404/75 |

FOREIGN PATENT DOCUMENTS

CN 107724395 A 2/2018

* cited by examiner

*Primary Examiner* — Raymond W Addie

(74) *Attorney, Agent, or Firm* — Bookoff McAndrews PLLC

(57) ABSTRACT

A method for determining a change in an angle of attack of a screed on a paving machine includes determining a first angle of attack of the screed, determining a second angle of attack of the screed based on data from at least one sensor located on the screed and at least one sensor located on a frame of the paving machine, and determining a change in the angle of attack based on the first angle of attack and the second angle of attack. The method also includes providing a notification of at least one of the first angle of attack, the second angle of attack, or the change in the angle of attack.

20 Claims, 5 Drawing Sheets

METHODS AND SYSTEMS FOR DETERMINING AN ANGLE OF ATTACK AND A CROSS SLOPE OF A PAVING MACHINE

TECHNICAL FIELD

The present disclosure relates generally to a road construction machine and, more particularly, to a control system for a paving machine.

BACKGROUND

The present disclosure relates to paving machines that are used in road surface construction and repairs. Paving machines are typically utilized to lay asphalt or other paving material. Paving machines generally include a screed system for spreading and compacting a mat of paving material relatively evenly over a desired surface. However, various operating conditions of paving machines may affect the angle of attack and the cross slope of the screeds of paving machines. Paving with a screed at an incorrect angle of attack may cause increased wear on screed plates and tamper bars, as well as causing mat defects. Further, excessive cross slope may cause excessive twisting between left and right main frames of a screed, which may cause interference between screed components and restrict movement in various moving parts of paving machines.

U.S. Pat. No. 9,534,348, issued to Rio et al. on Jan. 3, 2017 ("the '348 patent"), describes a method of reducing paver transition marks produced by a paving machine. The method described in the '348 patent involves sensing transition marks in a mat and adjusting a screed position based on the sensed transition marks. However, the method of the '348 patent does not address the angle of attack or a cross slope of a screed determined by sensors located on the screed and the frame of a paving machine.

The disclosed methods and systems may solve one or more of the problems set forth above and/or other problems in the art. The scope of the current disclosure, however, is defined by the attached claims, and not by the ability to solve any specific problem.

SUMMARY

In one aspect, a method for determining a change in an angle of attack of a screed on a paving machine may include determining a first angle of attack of the screed, determining a second angle of attack of the screed based on data from at least one sensor located on the screed and at least one sensor located on a frame of the paving machine, and determining a change in the angle of attack based on the first angle of attack and the second angle of attack. The method may also include providing a notification of at least one of the first angle of attack, the second angle of attack, or the change in the angle of attack.

In another aspect, a method for determining a change in an angle of attack of a screed on a paving machine may include determining a first angle of attack of the screed, determining a second angle of attack of the screed based on data from at least one sensor located on the screed, and determining a change in the angle of attack based on the first angle of attack and the second angle of attack. The method may also include automatically adjusting the angle of attack in response to the change in the angle of attack.

In yet another aspect, a system for a paving machine may include a screed, a sensor system arranged on the screed, and a controller for determining a change in an angle of attack of the screed or a cross slop. The controller may be configured to determine a first angle of attack of the screed, determine a second angle of attack of the screed based on data from the sensor system located on the screed, determine a change in the angle of attack based on the first angle of attack and the second angle of attack, and determine a cross slope of the screed based on data from a first sensor and a second sensor of the sensor system located on the screed. The controller may be further configured to provide a notification of at least one of the change in the angle of attack or the cross slope.

BRIEF DESCRIPTION OF THE DRAWINGS

The accompanying drawings, which are incorporated in and constitute a part of this specification, illustrate various exemplary embodiments and together with the description, serve to explain the principles of the disclosed embodiments.

DETAILED DESCRIPTION

Both the foregoing general description and the following detailed description are exemplary and explanatory only and are not restrictive of the features, as claimed. As used herein, the terms "comprises," "comprising," "having," "including," or other variations thereof, are intended to cover a non-exclusive inclusion such that a process, method, article, or apparatus that comprises a list of elements does not include only those elements, but may include other elements not expressly listed or inherent to such a process, method, article, or apparatus. Moreover, in this disclosure, relative terms, such as, for example, "about," "substantially," "generally," and "approximately" are used to indicate a possible variation of ±10% in the stated value.

For the purpose of this disclosure, the term "ground surface" is broadly used to refer to all types of surfaces that form typical roadways (e.g., asphalt, cement, clay, sand, dirt, etc.) or upon which paving material may be deposited in the formation of roadways. Although the current disclosure is described with reference to a paving machine, this is only exemplary. In general, the current disclosure can be applied to any machine that uses a screed-type system.

Figure 1:
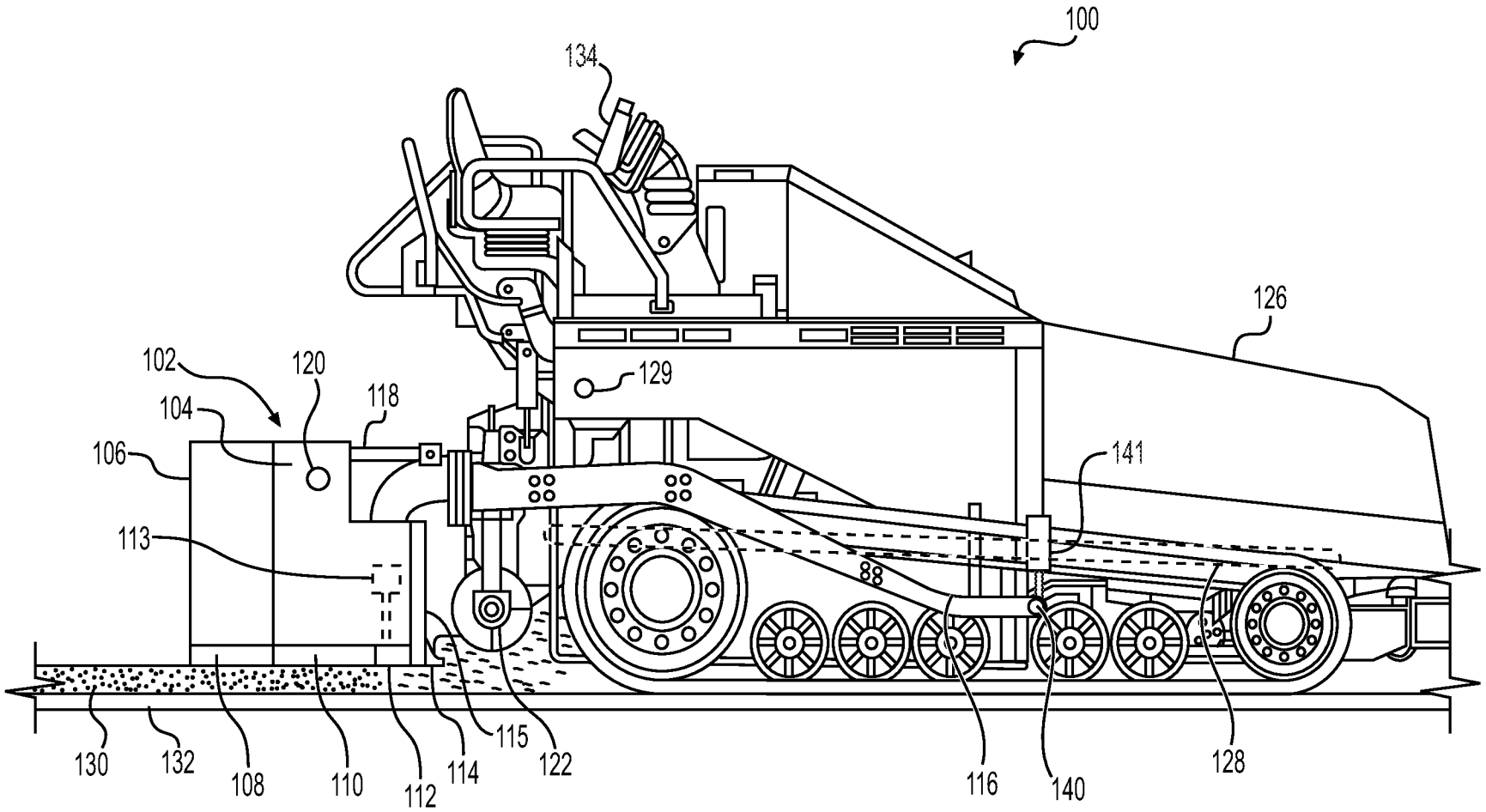
FIG. 1 is a schematic view of an exemplary screed assembly of an exemplary machine, according to aspects of this disclosure.

FIG. 1 illustrates one example of a paving machine 100 that incorporates the features of the present disclosure. Paving machine 100 may deposit or pave a mat 130 on a base 132. Paving machine 100 may include a screed assembly 102 and a pair of tow arms 116 (only one of which is visible in FIG. 1) attached to screed assembly 102 and tow points 140 located on a frame of machine 100 as shown in FIG. 1. Tow arms 116 may be attached to a pair of tow point cylinders 141 (only one of which is visible in FIG. 1). Tow point cylinders 141 may be configured to control the height of tow points 140 by adjusting hydraulic pressures within tow point cylinders 141, thereby controlling the height of tow arms 116. Paving machine 100 may further include a hopper 126 adapted for storing a paving material such as asphalt, and a conveyor system including one or more conveyors 128 configured for moving the paving material from hopper 126 to screed assembly 102 to a rear of paving machine 100. One or more augers 122 may be arranged near a forward end of screed assembly 102 to receive the paving material provided by conveyor 128 and spread the paving material evenly beneath screed assembly 102. Paving machine 100 may also include an inclinometer 129 attached to the frame of paving machine 100 as shown in FIG. 1. Inclinometer 129 may measure the angle at which paving machine 100 travels on base 132 (e.g., a ground surface). Additionally, paving machine 100 may include a display 134 for providing visual feedback of operation controls and/or conditions of paving machine 100.

Figure 4:
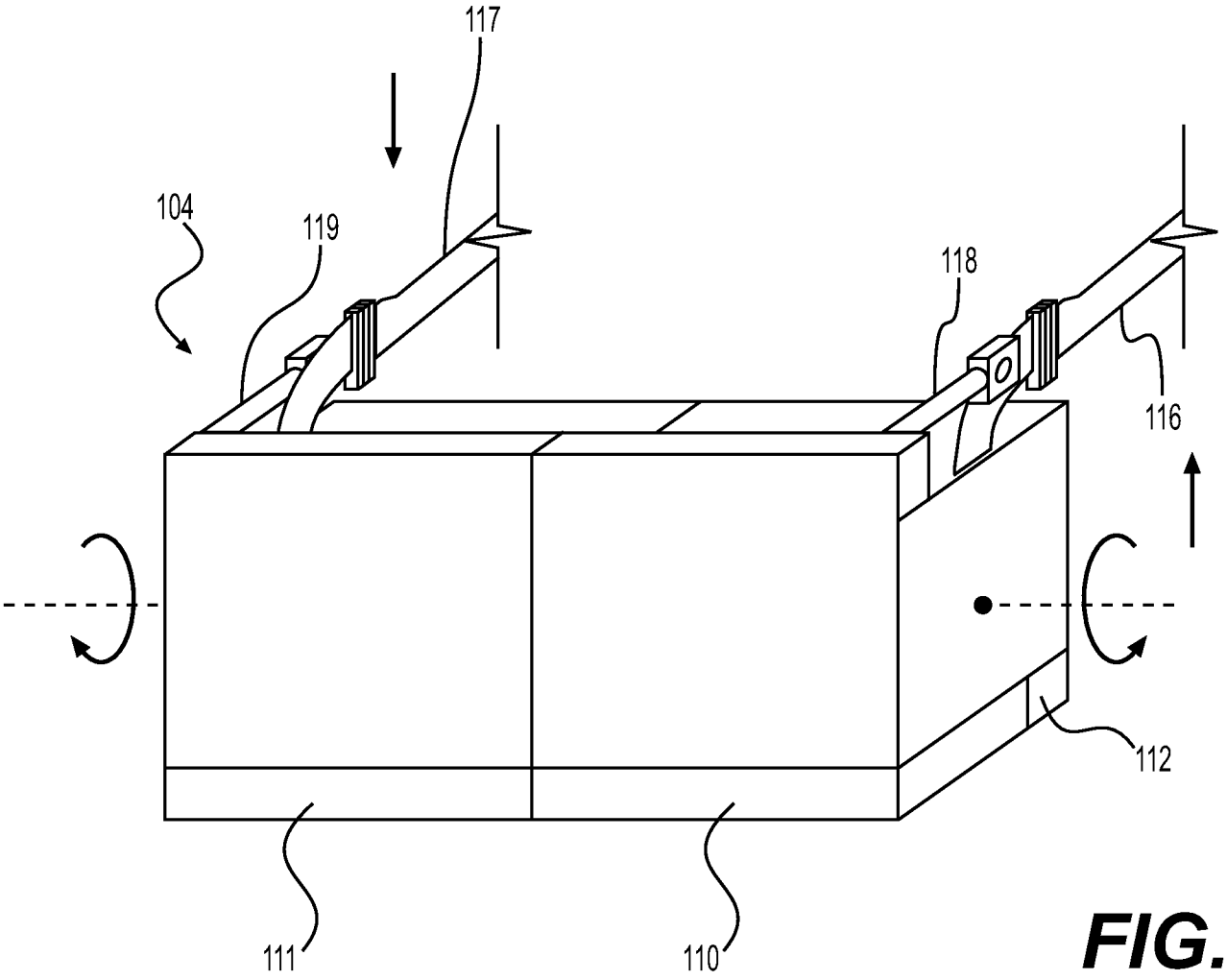
FIG. 4 is a schematic representation of a cross slope between a left and a right frame of the main screed of the screed assembly.

As shown in FIG. 1, screed assembly 102 may be pivotally connected (at tow point 140) behind paving machine 100 by tow arms 116, 117 (tow arm 117 is shown in FIG. 4). Tow arms 116, 117 may be configured to float so as to be raised and lowered as a function of the amount of paving material at an upstream end of the screed assembly 102. The relative position and orientation of screed assembly 102 relative to the frame of machine 100 and mat 130 may be adjusted by adjusting the tow point 140 connected to the pivoting tow arms 116, 117, in order, for example, to control the thickness of the paving material deposited via machine 100 and to adjust the angle of attack of screed assembly 102. Screed assembly 102 may include a main screed 104 and screed extenders 106 (only one of which is visible in FIG. 1). Screed extenders 106 may be configured, by a screed extender control 232, to be slidably movable laterally relative to main screed 104 between retracted and extended positions so that varying widths of paving material can be laid. Screed extenders 106 may include extender screed plates 108, 109 (extender screed plate 109 is shown in FIG. 2).

Main screed 104 may include a main screed plate 110, 111 (main screed plate 111 is shown in FIG. 4), a tamper bar 112, deflector 115, and a pre-strikeoff 114. Tamper bar 112 may be connected to a tamper bar controller 113 that is configured to move tamper bar 112 up and down so as to be able to strike the surface of the paving material after it is deposited by one or more augers 122. Tamper bar 112 may provide compaction of the paving material as well as affecting the angle of attack of screed assembly 102. Pre-strikeoff 114 may be attached (e.g., by welding) to deflector 115. The height of pre-strikeoff 144, which may affect the angle of attack of screed assembly 102, may be adjustable vertically by moving deflector 115 vertically up and down. Main screed 104 may also include inclinometers 120 (only one of which is shown in FIG. 1) in order to measure the angle of attack of screed assembly 102 relative to mat 130, and the cross slope or twist angle (cross slope and twist angle are used interchangeably hereinafter) of main screed 104.

Figure 2:
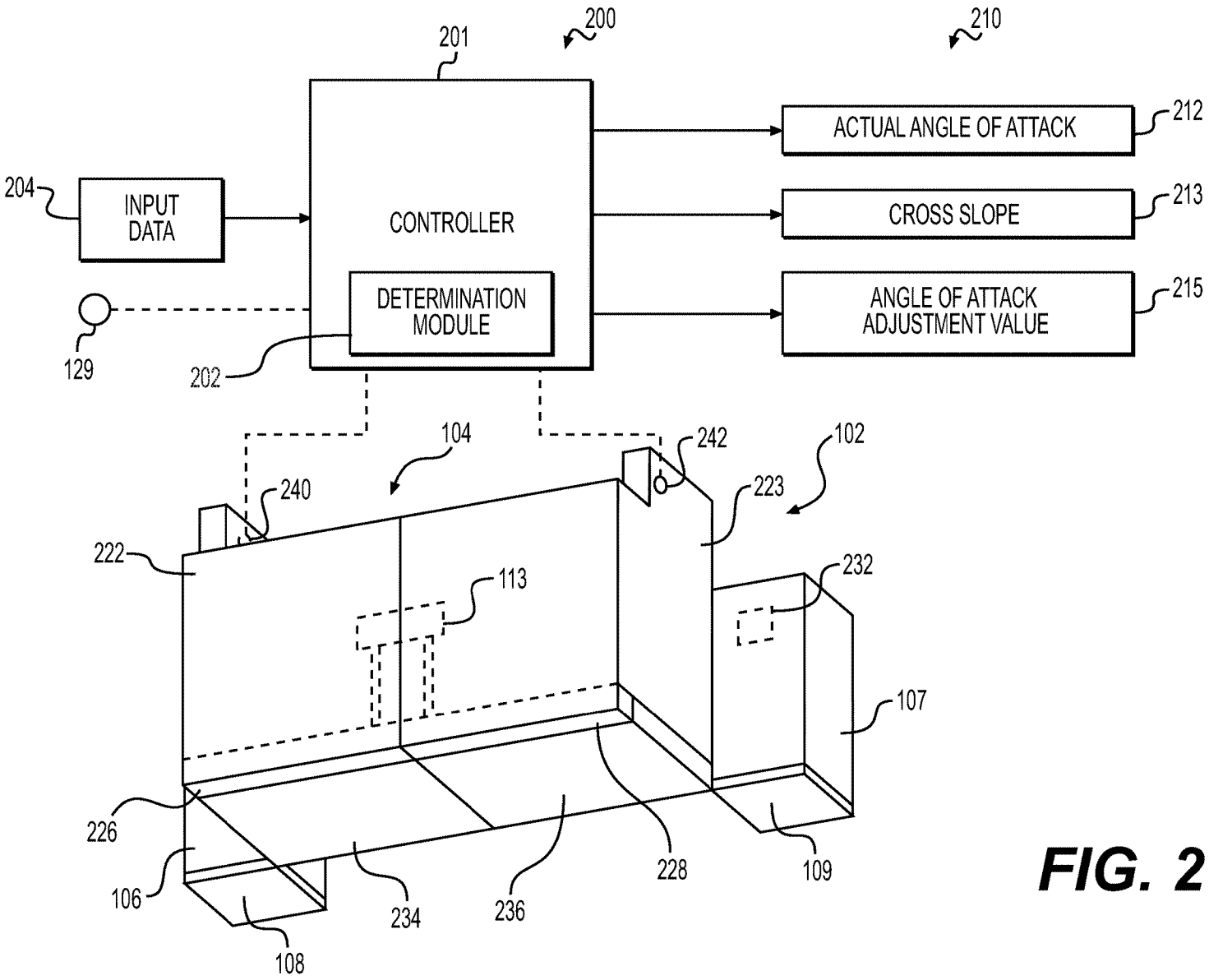
FIG. 2 is a schematic view of the exemplary screed assembly of FIG. 1 and a control system, according to aspects of this disclosure.

FIG. 2 illustrates a schematic view of screed assembly 102 and a control system 200. Control system 200 may be arranged on any suitable location on paving machine 100, and screed assembly 102 may be any of a number of configurations such as a fixed width screed, a screed extender, or a multiple section screed that includes extensions. In one aspect, screed assembly 102 may include main screed 104 with, alternatively or additionally, a left screed frame 222 and a right screed frame 223. Left screed frame 222 may include a left inclinometer 240 that may be mounted on an upper portion of left screed frame 222, and right screed frame 223 may include a right inclinometers 242 located on an upper portion of right screed frame 222 as shown in FIG. 2. Alternatively, inclinometers 240, 242 may be mounted on any other suitable locations of left and right screed frames 222, 223. Main screed 104 may also include a left tamper bar 226 and a right tamper bar 228, each of which is connected to a tamper bar controller 113. The tamper bar controller 113 may be configured to control the movement of the tamper bars 226, 228 to adjust the angle of attack of screed assembly 102. Additionally, main screed 104 may include a left main screed plate 234 and a right main screed plate 236. Screed assembly 102 may also include left and right extender screeds 106, 107 including left and right extender screed plates 108, 109, respectively.

Still referring to FIG. 2, control system 200 may include a controller 201. Controller 201 may be connected to left and right inclinometers 240, 242 and machine frame inclinometer 129. Controller 201 may receive signals generated by inclinometers 129, 240, 242. Controller 102 may embody a single microprocessor or multiple microprocessors that may include means for determining the angle of attack and/or the cross slope of screed assembly 102. For example, controller 102 may include a memory, a secondary storage device, and a processor, such as a central processing unit or any other means for accomplishing a task consistent with the present disclosure. The memory or secondary storage device associated with controller 102 may be non-transitory computer-readable media that store data and/or software routines that may assist controller 102 in performing its functions, such as the functions of method or process 500 of FIG. 5. Further, the memory or secondary storage device associated with controller 201 may also store data received from various inputs, for example, the signals received from left and right inclinometers 240, 242 and machine frame inclinometer 129. Numerous commercially available microprocessors can be configured to perform the functions of controller 201. It should be appreciated that controller 201 could readily embody a general machine controller capable of controlling numerous other machine functions. Various other known circuits may be associated with controller 201, including signal-conditioning circuitry, communication circuitry, hydraulic or other actuation circuitry, and other appropriate circuitry.

Additionally, controller 201 may include a determination module 202. Determination module 202 may be configured to receive various inputs. The various inputs may be signals received from, for example, at least left and right inclinometers 240, 242 and/or machine frame inclinometer 129. Determination module 202 may also receive input data 204, for example, from averaging skis (not shown in the figures) attached to paving machine 100. The averaging skis may provide, for example, reference data of the paving ground surface that paving machine 100 may utilize to adjust the positions of tow arms 116, 117 via tow point 140 during a paving operation. Input data 204 may also include operation control signals of paving machine 100, for example, a speed of paving machine 100, tow arm position control signal, deflector height control signal, etc. Determination module 202 may determine, based on the machine operation control signals, a desired angle of attack of screed assembly 102. Additionally, determination module 202 may determine an actual angle of attack 212 based on the data received from inclinometers 240, 242. Determination module 202 may also determine an angle of attack adjustment value 215 based on actual angle of attack 212 and the desired angle of attack of screed assembly 102. Additionally or alternatively, determination module 202 may utilize, in addition to inclinometers 240, 242, the signals received from machine frame inclinometer 129 and/or averaging skis in determining actual angle of attack 212. In another aspect, determination module 202 may determine a cross slope 213 based at least on the received input signals from inclinometers 240, 242.

Figure 3:
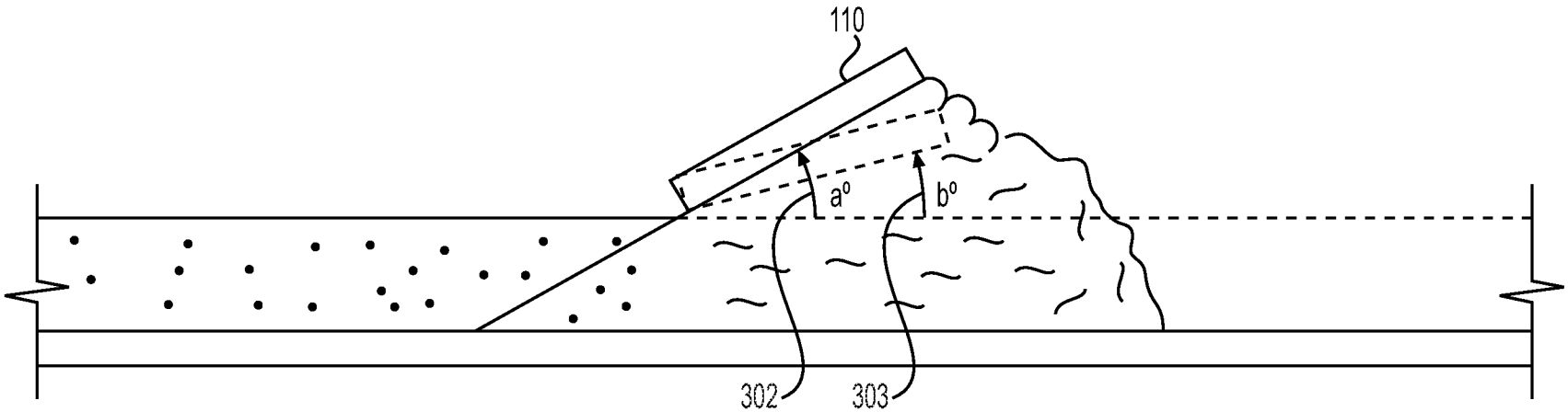
FIG. 3 is a schematic representation of an angle of attack of the exemplary screed assembly.

FIG. 3 illustrates a schematic representation of the angle of attack of screed assembly 102. For example, FIG. 3 shows an actual angle of attack 302 and a desired angle of attack 303 of screed assembly 102 that may be determined by determination module 202. It is noted that, for clarity, only main screed plate 110 of screed assembly 102 is illustrated in FIG. 3 to show the angle of attack of screed assembly 102. Desired angle of attack 303 of screed assembly 102 may be based at least on an operation command received by an operator of paving machine 100 for controlling screed assembly 102. Further, the angle of attack of screed assembly 102 may be affected by various factors, including but not limited to, material feed control (e.g., head of material), changes in paving speed, changes in paving width, paving material mix type, incorrect take off settings (e.g., null/tow point height), and/or a tamper bar speed. An incorrect angle of attack may cause at least an erratic screed behavior, inconsistent paving material density, open textures in a mat, increased wear of screed components, and/or mat defects. As such, in order to prevent the above-described effects of the incorrect angle of attack, various adjustments may be made before or during paving operation of paving machine. For example, the angle of attack of screed assembly 102 may be adjusted before paving operation or while paving machine 100 is stationary by changing at least a height of tow points 140 using thickness screws 118, 119 to null screed assembly 102, changing pre-strikeoff height by adjusting deflector 115, and/or adding counter balance of screed assembly 102 by adjusting hydraulic pressure applied to screed lift cylinders (not shown in the figures) for reducing the weight of screed assembly 102. Additionally or alternatively, the angle of attack of screed assembly 102 may be adjusted while performing paving operation by at least changing tamper bar speed, changing prestrike off height, adding counter balance, and/or verifying proper head of material. The head of material may be adjusted or verified by at least controlling the paving speed of paving machine 100, adjusting the material feed ratio setting, and/or using feeder sensors to control the level of material at the outboard end of augers 122.

FIG. 4 illustrates a schematic representation of a cross slope (or twist angle) between left and right screed frames 222, 223. As shown in FIG. 4, different pressures (indicated by up and down arrows next to tow arms 116, 117) exerted to actuation cylinders (not shown in the figures) attached to tow arms 116, 117, and/or uneven ground surface conditions may cause tow arms 116, 117 to move in opposite directions, causing twists between left screed frame 222 and right screed frame 223. Such twists may cause excessive stress in left and right screed frames 222, 223, and cause interference between screed components that may restrict movement in moving parts of screed assembly 102.

Referring back to FIG. 2, controller 201 may be configured to provide outputs 210 determined by determination module 202. Outputs 210 may include actual angle of attack 212, cross slope 213, and/or angle of attack adjustment value 215. Control system 200 may utilize outputs 210 to adjust the operation commands for controlling screed assembly 102. In one aspect, determination module 202 may determine, for example, by using an averaging formula, actual angle of attack 212 based on the signals received from inclinometers 129, 240, 242 before or during the paving operation. Determination module 202 may then calculate angle of attack adjustment value 215 based on desired angle of attack 303 and determined actual angle of attack 212. Further, inclinometers 129, 240, 242 may be calibrated (e.g., setting inclinometer values to be zero) before takeoff or after nulling screed assembly 102. Thus, while paving, only a difference between inclinometers 240, 242 on screed assembly 102 and inclinometer 129 on the frame of paving machine 100 may need to be determined and monitored. In one aspect, a few readings from inclinometers 129, 240, 242 may be measured over a predetermined distance. Accordingly, an average of the readings from inclinometers 129, 240, 242 over the predetermined distance may be utilized to make adjustments to screed assembly 102 for stabilizing screed assembly 102 after an adjustment or take off of paving machine 100. Additionally or alternatively, determination module 202 may calculate cross slope 213 based on the signals received from inclinometers 240, 242 mounted on main screed 104. Accordingly, control system 200 may utilize input data 204 and outputs 210 to prevent or reduce the cross slope of main screed 104 and/or adjust the angle of attack of screed assembly 102 by at least adjusting the tamper bar speed, adjusting pre-strikeoff height, and/or providing the operator notification/feedback of the operation performance of paving machine 100 (e.g., actual and desired angle of attack, an angle of attack adjustment value, a cross slope, etc.).

INDUSTRIAL APPLICABILITY

Figure 5:
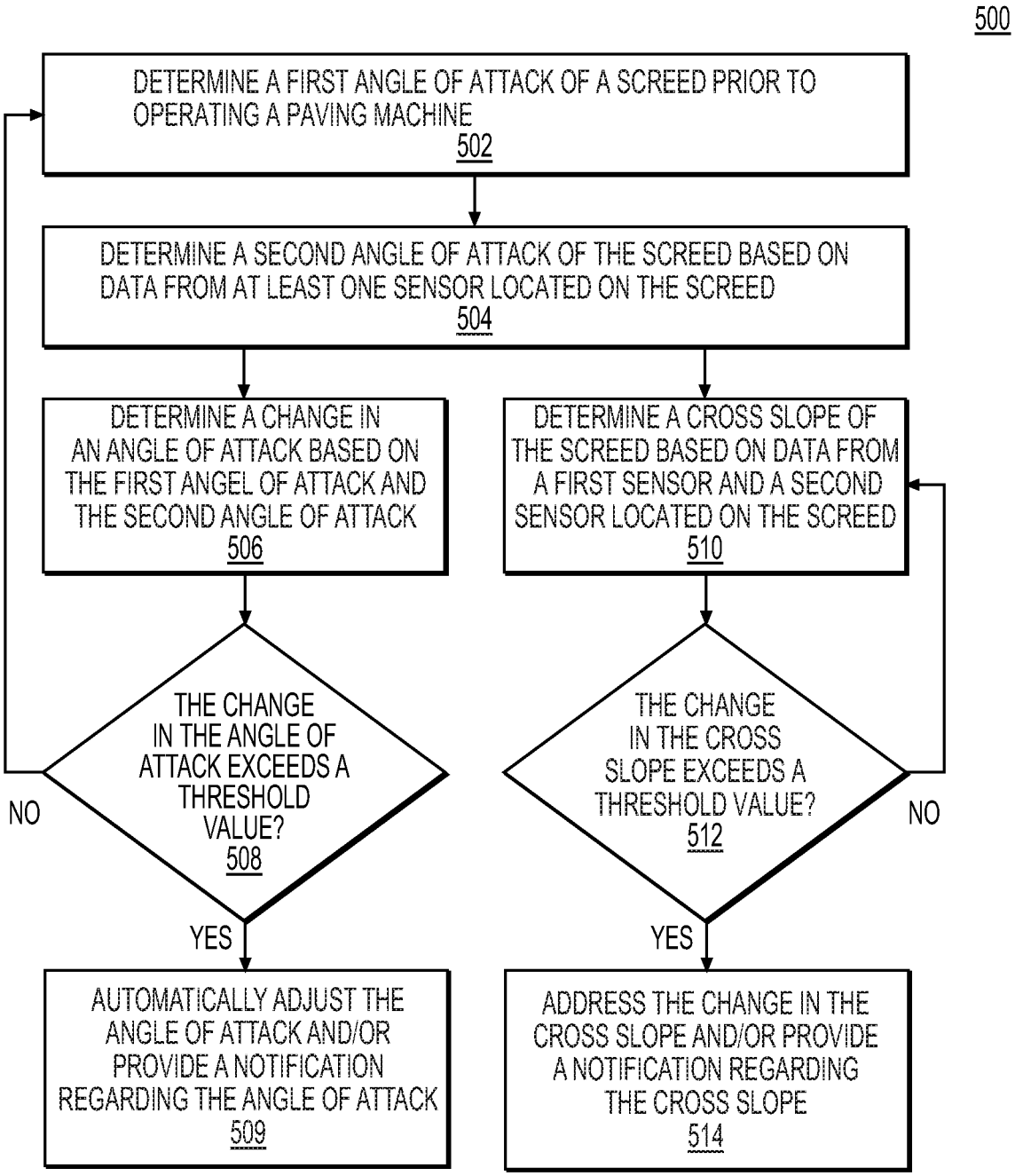
FIG. 5 provides a flowchart depicting an exemplary method for determining an angle of attack and a cross slope for the exemplary screed assembly of FIGS. 1 and 2, according to aspects of this disclosure.

The disclosed aspects of system 200 and method 500 described herein may be used before or during operation of any paving machine used in a variety of settings. In particular, system 200 of paving machine 100 described herein may monitor a change in the angle of attack and the cross slope of screed assembly 102 in order to provide notification of the change in the angle of attack and the cross slope. Additionally, system 200 may automatically adjust the operation commands of paving machine 100 in order to prevent negative effects of an incorrect angle of attack and excessive cross slope of screed assembly 102 on paving machine 100. The negative effects may include, for example, but not limited to, erratic screed behavior, paving material density issues, open texture in a paving mat, increased wear of screed components, and/or paving mat defects. FIG. 5 illustrates a flowchart depicting an exemplary method 500 for providing notifications related to the angle of attack and the cross slope of screed assembly 102, and automatically adjusting the angle of attack and the cross slope of screed assembly 102 in order to prevent or eliminate the above-described negative effects.

In step 502, determination module 202 may determine a first angle of attack of screed assembly 102 prior to performing paving operation by paving machine 100. The first angle of attack may include desired angle of attack 302. Desired angle of attack 302 may be determined based on various paving machine 100 operating control signals received from the operator.

In step 504, determination module 202 may determine a second angle of attack of screed assembly 102 based on data from at least one sensor located on screed assembly 102. In one aspect, the second angle of attack may be determined in real-time during a paving operation, and the second angle of attack may include actual angle of attack 212. The at least one sensor may include inclinometers 129, 240, 242, or any other sensor capable of detecting a relative angle of screed assembly 102 and/or paving machine 100 with respect to an operating ground surface of paving machine 100. In one aspect, the second angle of attack may be determined based on data received from a single inclinometer mounted on a frame of main screed 104 of screed assembly 102. Alternatively, the second angle of attack may be determined based at least on two inclinometers, including at least one inclinometer mounted on screed assembly 102 and at least one inclinometer mounted on a frame of paving machine 100. Inclinometer 129 mounted on the frame of paving machine 100 may detect a relative angle of paving machine 100 with respect to an operating ground surface of paving machine 100. Determination module 202 may incorporate the relative angle of paving machine 100 detected by inclinometer 129 into the sensor data obtained from inclinometers 240, 242 to improve the accuracy of the angle of attack determination. In another aspect, determination module 202 may additionally utilize the data received from the averaging skis of paving machine 100 to determine the second angle of attack.

In step 506, determination module 202 may determine a change in the angle of attack of screed assembly 102 based on a difference between the first angle of attack and the second angle of attack. Determination module 202 may determine, in step 508, whether the change in the angle of attack exceeds a predetermined threshold value. Additionally or alternatively, in step 510, determination module may determine a cross slope (or a twist angle) of screed assembly 102 based on data from at least two sensors (e.g., inclinometers 240, 242) mounted on screed assembly 102. For example, a cross slope may be determined based on a comparison of measured twist from inclinometers 240, 242 or other sensors associated with left screed frame 222 and right screed frame 223. In one aspect, one of the at least two sensors may be mounted on left screed frame 222 and at least another one of the at least two sensors may be mounted on right screed frame 223. In step 512, determination module 202 may determine whether the change in the cross slope exceeds a predetermined threshold value.

In step 509, system 200 may automatically adjust the angle of attack of screed assembly 102 and/or provide a notification of the change in the angle of attack in response to the difference between the first angle of attack and the second angle of attack. That is, if the change in the angle of attack exceeds the predetermined threshold value, system 200 may automatically adjust the angle of attack of screed assembly 102. However, if the change in the angle of attack does not exceed the predetermined threshold value, the method 500 may restart from step 502. The angle of attack of screed assembly 192 may be automatically adjusted, for example, by adjusting at least (1) a tamper bar speed, (2) a counter balance of screed assembly, (3) a pre-strikeoff height, and/or (4) a head of paving material. The counter balance of screed assembly may be adjusted by adjusting the hydraulic pressures applied to the screed lift cylinders. The pre-strikeoff height may be adjusted by adjusting the vertical position of deflector 115. The head of paving material may be adjusted by controlling the amount of paving material fed to screed assembly 102. Additionally, in step 514, system 200 may address the change in the cross slope and/or provide a notification regarding the cross slope based on the determination result of step 512. For example, system 200 may address the change in the cross slope by preventing further tow point 140 movement in the direction of a higher cross slope or twist angle when the change in the cross slope exceeds a predetermined threshold value. Additionally or alternatively, system 200 may automatically adjust the cross slope of screed assembly 102 by adjusting pressures applied to the tow point cylinders 141 to raise or lower tow point 140 when the change in the cross slope exceeds a predetermined threshold value. Alternatively or additionally, the cross slope may also be adjusted by adjusting thickness screws 118, 119 or by adjusting depth cranks.

In steps 509 and 514, determination module 202 may provide a notification regarding the angle of attack and the cross slope, respectively. The notification may be provided to the operator of paving machine 100 visually on a display or by sound via at least a speaker. In one aspect, the notification regarding the angle of attack may be a display listing an actual angle of attack or a change in the angle of attack from a desired/present angle of attack (e.g., angle of attack above a predetermined threshold). Additionally, a notification regarding the cross slope may be a display listing an actual cross slope or a change in the cross slope from a desire/present cross slope (e.g., cross slope above a predetermined threshold) or a textual notification or alarm notification of cross slope outside the predetermined threshold. Moreover, the notification may include a real-time angle of attack 212 or a real-time cross slope 213 of screed assembly that may be provided on a display 134 of the paving machine 100. The notification may be provided when the change in the angle of attack or the cross slope exceeds a predetermined threshold value. Additionally or alternative, the angle of attack of screed assembly 102 may be adjusted manually by the operator of paving machine 100. For example, before paving machine 100 performs a paving operation or while paving machine 100 is stationary, the operator may, based on the change in the angle of attack of screed assembly 102 provided in the notification, input appropriate operation commands to adjust tow point 140 height, adjust thickness screws 118, 119 to null screed assembly 102, change pre-strikeoff height, and/or add counter balance to screed assembly 102. Any of the described manual adjustments, singly or in combination, may affect the angle of attack of screed assembly 102.

It will be apparent to those skilled in the art that various modifications and variations can be made to the disclosed system without departing from the scope of the disclosure. Other embodiments of the system will be apparent to those skilled in the art from consideration of the specification and practice of the system disclosed herein. It is intended that the specification and examples be considered as exemplary only, with a true scope of the disclosure being indicated by the following claims and their equivalents.

What is claimed is:

1. A method for determining a change in an angle of attack of a screed on a paving machine, the method comprising:

determining a first angle of attack of the screed;

determining a second angle of attack of the screed based on data from at least one sensor located on the screed and at least one sensor located on a frame of the paving machine, the at least one sensor located on the frame of the paving machine being spaced away from a screed assembly that includes a pair of tow arms;

determining a change in the angle of attack based on the first angle of attack and the second angle of attack; and providing a notification of at least one of the first angle of attack, the second angle of attack, or the change in the angle of attack.

2. The method of claim 1, wherein the first angle of attack is a desired angle of attack, the second angle of attack is a determined, real-time angle of attack during a paving operation, and the change in the angle of attack is a difference between the first and second angle of attacks.

3. The method of claim 1, wherein the providing of a notification includes providing a notification to an operator of the paving machine during a paving operation.

4. The method of claim 1, wherein the providing of a notification includes providing a notification of the change in the angle of attack when the change in the angle of attack exceeds a threshold value.

5. The method of claim 1, wherein the providing of a notification includes providing the first angle of attack, the second angle of attack, and the change in angle of attack on a display of the paving machine.

6. The method of claim 1, wherein the at least one sensor located on the screed includes an inclinometer.

7. The method of claim 1, further comprising automatically adjusting the angle of attack in response to the change in the angle of attack.

8. A method for determining a change in an angle of attack of a screed on a paving machine, the method comprising:

determining a first angle of attack of the screed;

determining a second angle of attack of the screed based on data from at least one sensor located on the screed and at least one sensor located on a frame of the paving machine or an averaging ski; and determining a change in the angle of attack based on the first angle of attack and the second angle of attack; and automatically adjusting the angle of attack, including automatically adjusting at least one of a counter balance of the screed or a pre-strikeoff height of the screed, in response to the change in the angle of attack.

9. The method of claim 8, wherein the first angle of attack is a desired angle of attack, the second angle of attack is a determined, real-time angle of attack during a paving operation, and the change in the angle of attack is a difference between the first and second angle of attacks.

10. The method of claim 8, wherein the automatically adjusting the angle of attack includes automatically adjusting the angle of attack when the change in the angle of attack exceeds a threshold value.

11. The method of claim 8, wherein automatically adjusting the angle of attack further includes automatically adjusting at least a tamper bar speed and/or a head of paving material.

12. The method of claim 8, wherein the at least one sensor located on the screed includes an inclinometer, and the at least one sensor located on the frame of the paving machine includes an inclinometer.

13. The method of claim 8, further comprising determining a cross slope of the screed based on the data from the at least one sensor located on the screed, wherein the at least one sensor located on the screed includes a first sensor and a second sensor.

14. A system for a paving machine, comprising:

a frame;

a screed assembly including a screed and a pair of tow arms;

a sensor system including:

at least two sensors arranged on the screed; and at least one sensor located on the frame of the paying machine spaced away from the screed assembly; and a controller for determining a change in an angle of attack of the screed or a cross slope, the controller being configured to:

determine a first angle of attack of the screed;

determine a second angle of attack of the screed based on data from at least one of the at least two sensors of the sensor system located on the screed and the at least one sensor located on the frame of the paving machine;

determine a change in the angle of attack based on the first angle of attack and the second angle of attack;

determine a cross slope of the screed based on data from the at least two sensors of the sensor system located on the screed; and provide a notification of at least one of the change in the angle of attack or the cross slope.

15. The system of claim 14, wherein the controller is further configured to:

automatically adjust the angle of attack in response to the change in the angle of attack, the change in the angle of attack exceeding a threshold value; and/or address the change in the cross slope when the change in the cross slope exceeds a threshold value.

16. The system of claim 14, wherein the first angle of attack is a desired angle of attack, the second angle of attack is a determined, real-time angle of attack during a paving operation, and the change in the angle of attack is a difference between the first and second angle of attacks.

17. The system of claim 14, wherein the at least two sensors of the sensor system located on the screed include an inclinometer, and the at least one sensor located on the frame of the paving machine includes an inclinometer.

18. The system of claim 14, wherein automatically adjusting the angle of attack includes automatically adjusting at least a tamper bar speed, a counter balance of the screed, a pre-strikeoff height, or a head of paving material.

19. The system of claim 14, wherein the controller is further configured to provide a notification of at least a real-time angle of attack and/or a real-time cross slope of the screed on a display of the paving machine.

20. The system of claim 14, wherein the at least two sensors arranged on the screed include a first inclinometer located on one side of the screed and a second inclinometer located on another side opposite the one side of the screed.

* * * * *